United States Patent [19]

Takahashi et al.

[11] Patent Number: 4,717,636

[45] Date of Patent: Jan. 5, 1988

[54] ELECTROPHOTOGRAPHIC PHOTOSENSITIVE MEMBER CONTAINING POLYVINYLARYLAL

[75] Inventors: Hideyuki Takahashi, Yokohama; Masataka Yamashita, Kawasaki; Masakazu Matsumoto, Yokohama; Minoru Mabuchi, Tokyo, all of Japan

[73] Assignee: Canon Kabushiki Kaisha, Tokyo, Japan

[21] Appl. No.: 853,160

[22] Filed: Apr. 17, 1986

[30] Foreign Application Priority Data

Apr. 23, 1985 [JP] Japan ..... 60-085343

[51] Int. Cl.[4] ..... G03G 5/14

[52] U.S. Cl. ..... 430/58; 430/59; 430/96

[58] Field of Search ..... 430/58, 59, 96

[56] References Cited

U.S. PATENT DOCUMENTS 4,278,747 7/1981 Murayama et al. ..... 430/58 X

FOREIGN PATENT DOCUMENTS 58-17447 2/1983 Japan ..... 430/58

58-98736 6/1983 Japan ..... 430/59

*Primary Examiner*—Roland E. Martin

*Attorney, Agent, or Firm*—Fitzpatrick, Cella, Harper & Scinto

[57] ABSTRACT

An electrophotographic photosensitive member comprises at least a charge generation layer and a charge transport layer on an electroconductive substrate, wherein said charge generation layer contains, as a binder, a polyvinylacetal resin obtained by acetalization reaction of polyvinyl alcohol and aldehyde compound represented by the following general formula:

Ar-CHO wherein Ar stands for a substituted or unsubstituted aryl radical.

8 Claims, No Drawings

ELECTROPHOTOGRAPHIC PHOTOSENSITIVE MEMBER CONTAINING POLYVINYLARYLAL

BACKGROUND OF THE INVENTION

1. Field of the Invention

The present invention relates to an electrophotographic photosensitive member in which functions are separated, and in particular to an improvement in a charge generation layer for improving electrophotographic characteristics.

2. Related Background Art

There has recently been proposed an electrophotographic photosensitive member in which the photosensitive layer is separated in functions as a laminar structure of a charge generation layer and a charge transport layer. Various improvements have been made, on such photosensitive member, in sensitivity to visible light, charge retaining power, surface strength etc. as disclosed for example in the U.S. Pat. Nos. 3,837,851 and 3,871,882.

Such photosensitive member with separated functions is composed at least of a charge generation layer and a charge transport layer. Charge carriers generated by light absorption in the charge generation layer are injected into the charge transport layer and move to the surface to neutralize the surface charge of the photosensitive member, thereby generating electrostatic contrast.

In the above-described process, the charge generation layer plays an extremely important role. More specifically, electrophotographic characteristics such as uniform and abundant generation of charge carriers, effective injection of thus generated charge carriers into the charge transport layer and method of smooth dissipation of opposite charge carriers to the support principally rely on the charge generation layer. The charge generation layer is essentially composed of a binder and an organic pigment which is a charge generating material, and the weight ratio of the binder to the organic pigment is generally as high as 25 to 100 wt.%. Consequently the binder has an extremely important effect on the movement of charge carriers generated in the charge generation layer, and the basic structure, functional groups, molecular weight, purity etc. of the binder are deeply related with the electrophotographic characteristics of the photosensitive member such as the sensitivity, charge potential, durability etc.

However, in prior references and patents, the binder in the charge generation layer has been regarded as an auxiliary material for the organic pigment, which is the charge generating material, for simply providing dispersibility and adhesion.

For this reason, conventional function-separated electrophotographic photosensitive member has been associated with various defects in potential characteristics such as retentive potential, potential functuation, photomemory (an undesirable effect of an image to an immediately following image in case of continuous image formation). Also the sensitivity is not sufficient.

The present inventors have understood the binder as another principal electronic material in the charge generation layer, and have reached the present invention through the understanding of the binder from its molecular aspect, such as structure, molecular weight, purity etc.

SUMMARY OF THE INVENTION

An object of the present invention is to provide a novel binder for use in the charge generation layer, and to provide an electrophotographic photosensitive member with improved charging characteristics.

Another object of the present invention is to provide an electrophotographic photosensitive member with a practical high sensitivity and stable potential characteristics in repeated use.

The foregoing objects can be achieved, according to the present invention, by an electrophotographic photosensitive member comprising at least a charge generation layer and a charge transport layer on an electroconductive substrate, wherein said charge generation layer comprises a polyvinylacetal resin, as a binder, obtained by acetalization of polyvinyl alcohol and an aldehyde compound represented by the general formula:

Ar-CHO wherein Ar stands for a substituted or unsubstituted aryl radical.

DESCRIPTION OF THE PREFERRED EMBODIMENT

In the foregoing general formula, the radical Ar represents a substituted or unsubstituted aryl radical. Examples of the radical Ar are phenyl, naphtyl, acenaphthyl, anthryl, pyrenyl, phenanthryl and axulenyl. Examples of the substituent of said aryl radicals are halogen atoms (fluorine, chlorine, bromine, iodine etc.), substituted or unsubstituted alkyl radicals (methyl, ethyl, propyl, isopropyl, n-butyl, tert-butyl, 2-methoxyethyl etc.), substituted or unsubstituted aralkyl radicals (benzyl, phenetyl, chlorobenzyl, bromobenzyl etc.), substituted or unsubstituted aryl radicals (phenyl, tolyl, chlorophenyl, naphthyl etc.), alkoxy radicals (methoxy, ethoxy, propoxy etc.), aryloxy radicals (phenoxy, naphthoxy etc.), substituted amino radicals (dimethylamino, diethylamino, piperidino, morphoryl, pyrrolidino etc.), nitro radical and cyano radical. Also there may be present plural substituents.

The polyvinylacetal resin to be employed in the present invention is provided with a weight-averaged molecular weight in a range from 10,000 to 200,000, preferably from 30,000 to 80,000. The degree of acetalization is to be at least equal to 50 mol.%, preferably in a range from 65 to 90 mol.%. The content of remaining vinyl acetate component, resulting from polyvinyl alcohol employed as the raw material, should preferably be as low as possible, and polyvinyl alcohol employed as the raw material should preferably have the degree of saponification at least equal to 85%.

In the electrophotographic photosensitive member with a charge generation layer containing the above-explained polyvinylacetal resin, the reason for improvement in the potential characteristics is still not clear, but the sensitivity and photomemory property is presumably improved because of an improved charge transportability and a less tendency of carrier trapping due to the presence of aromatic rings in the resin structure, in comparison with commercially available butyral resins prepared from, butyl aldehyde and polyvinyl alcohol.

In the following there are shown examples of acetal structure of the polyvinyl acetal resin to be employed in the present invention:

| Resin Example NO. | Acetal structure |
|---|---|
| 1. | 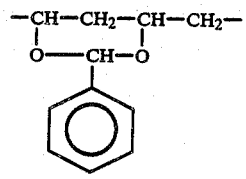 |
| 2. | 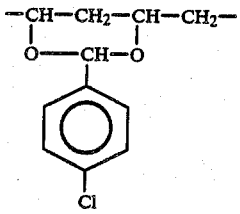 |
| 3. | 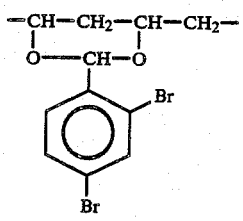 |
| 4. | 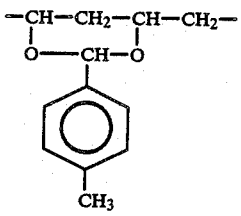 |
| 5. | 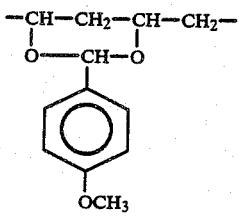 |
| 6. | 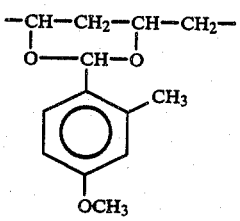 |
| 7. | 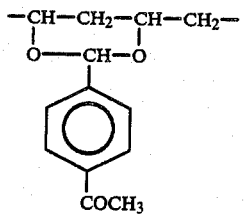 |
-continued
| Resin Example NO. | Acetal structure |
|---|---|
| 8. | 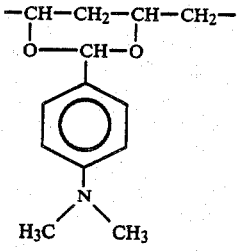 |
| 9. | 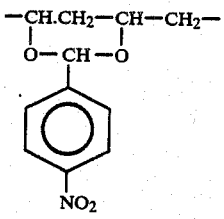 |
| 10. | 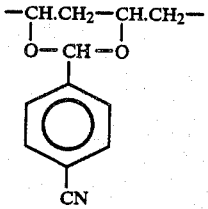 |
| 11. | 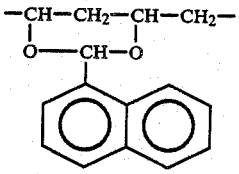 |
| 12. | 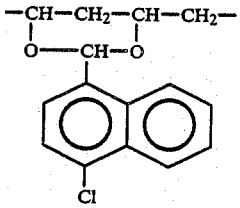 |
| 13. | 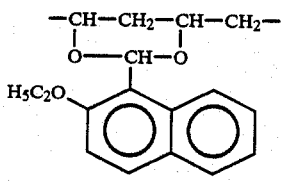 |
| 14. | 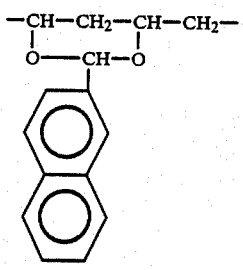 |

-continued

| Resin Example NO. | Acetal structure |
|---|---|
| 15. | 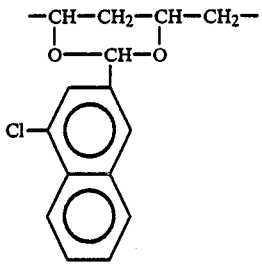 |
| 16. | 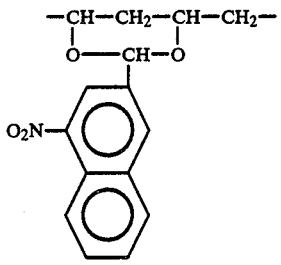 |
| 17. | 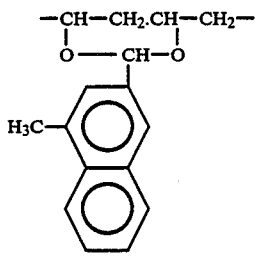 |
| 18. | 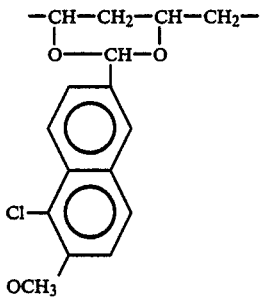 |
| 19. | 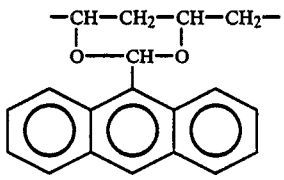 |

In the foregoing there are shown 19 acetal resins, but the present invention is not limited to these examples.

Determination of weight-average molecular weight

The molecular weight of polyvinyl benzol was determined by the gel permeation chromatography (GPC) under the following conditions.

Apparatus: High speed liquid chromatograph, TRI ROTAR SR2 (supplied by Nippon Bunko K.K.)

Detector: Differential refractometric detector for high speed liquid chromatography (supplied by Showa Denko K.K.)

Column: GPC A-80M (supplied by Showa Denko K.K.)

Reference material: Standard polystyrene

Solvent: Tetrahydrofuran

Temperature: 40±1 ° C.

Flow rate: 1 ml/min

Determination of degree of acetalization

About 0.4 g of polyvinyl benzol was precisely weighted out, and 10 ml of butyl alcohol and 10 ml of lN-solution of hydroxylamine hydrochloride were added thereto. The mixture was then refluxed at 90–100 ° C. for one hour to effect dissociation of acetal. After the temperature of the liquid fell sufficiently, 10 ml of methanol was added followed by stirring. The solution was titrated with 0.1N-sodium hydroxide solution to determine the quantity of hydroxylamine hydrochloride used for the dissociation of acetol. The end point of titration was a point in the time when the pH value reached 3.5.

The degree of benzalization (mol.%) is calculated by the formula:

$$B(\text{wt.}) = \frac{1.76 \times (\alpha - \beta) \times F}{S \times P} \times 100$$

wherein $\alpha$ is quantity (g.) of 0.lN-sodium hydroxide solution required for the titration, $\alpha$ is quantity (g.) of 0.lN-sodium hydroxide used for blank test, F is the titer of 0.lN-sodium hydroxide solution, S is mass (g.) of sample, and P is purity (%) of sample.

$$B(\text{mol}) = \frac{B(\text{wt.}) \times 100/176}{B(\text{wt.})/176 + [100 - B(\text{wt.})]/88}$$

wherein the values, 176 and 88 represent, respectively, the molecular weight of unit:

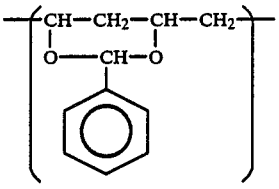

of polyvinyl benzal, and that of unit:

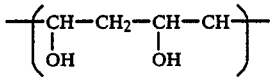

of polyvinyl alcohol.

The polyvinylacetal resin of the present invention can be easily synthesized by reacting polyvinyl alcohol with the above-mentioned aldehyde at 20° to 70° C., in the presence of an acid such as hydrochloric acid or sulfuric acid, and for example in a mixture of methanol and benzene.

In the following there will be explained examples of synthesis of the polyvinylacetal resin of the present invention.

SYNTHESIS EXAMPLE, RESIN EXAMPLE 1

A mixture of 250 gr. of methanol and 250 gr. of benzene was charged in a 3 liters three-necked flask, then 50 gr. of polyvinyl alcohol (supplied by Kuraray; degree of polymerization 500; degree of saponification 98.5 ±0.5 mol.%) and 750 gr. of benzaldehyde were added under agitation, and 5 gr. of concentrated hydrochloric acid was added dropwise. Agitation was continued for 40 hours at a temperature of 40–45° C. After the reaction, the reaction mixture was poured into a solution of 4 gr. of sodium hydroxide in 10 liters of methanol, and the precipitated resin was collected by filtration and washed with water. The resin was then dissolved in 2 liters of 1:1 mixture of acetone and benzene and dropwise added into 18 liters of methanol for purification by reprecipitation. The resin was collected by filtration and dried under a reduced pressure. The yield was 83 gr.

The degree of acetalization said resin was 82% when measured according to a method defined in the Japanese Industrial Standard K6728 (Test methods for polyvinylbutyral).

Other polyvinylacetal resins employable in the present invention can also be synthesized in a similar manner.

The binder of the charge generation layer should not hinder the transport of the carriers generated in said layer as far as possible, and for this reason the weight content of said binder in said layer should be as low as possible. However, in order to achieve practical binding property and to secure stability in the pigment dispersion, said weight content should at least be equal to 20 wt.%, is usually in a range from 25 to 90 wt.% and preferably in a range from 28 to 50 wt.%.

Also the binder of the present invention may be mixed with other already known binders.

The charge generation layer to be employed in the present invention can be obtained by dispersing, in said binder, an inorganic or organic pigment selected from charge generating materials such as selenium, selenium-tellurium, amorphous silicon, pyrylium dyes, thiopyrylium dyes, azulenium dyes, phthalocyanine pigments, anthanthrone pigments, dibenzpyrene quinone pigments, pyranthrone pigments, tetrakisazo pigments, trisazo pigments, disazo pigments or other azo pigments, indigo pigments, quinacridone pigments, asymmetric quinocyanine dyes or quinocyanine pigments. Specific examples of such charge generating material are amorphous silicon, selenium-tellurium, selenium-arsenide, cadmium sulfide and organic pigments disclosed in the Japanese Patent Application No. 271793/1984.

A coating mixture is prepared by dispersing said charge generating material together with the binder of the present invention, and in said dispersion the can be employed an organic solvent for example ketones such as acetone, methylethylketone or cyclohexanone; amides such as N,N-dimethylformamide or N,N-dimethylacetamide; sulfoxides such as dimethylsulfoxide; ethers such as tetrahydrofurane, dioxane or ethylene glycol monomethylether; esters such as methyl acetate or ethyl acetate; aliphatic halogenated hydrocarbons such as chloroform, methylene chloride, dichloroethylene, carbon tetrachloride or trichloro-ethylene; or aromatic solvents such as benzene, toluene, xylene, ligroin, monochlorobenzene or dichlorobenzene.

The dispersion can be achieved by crushing the above-mentioned solvent, charge generating material and binder with a sand mill, a ball mill, a roll mill or an attritor until a predetermined particle size is obtained. The particle size and the amount of binder are closely related with the stability of obtained dispersion and the characteristics of the photosensitive member, and have therefore to be carefully determined.

Application can be achieved by various coating methods such as dip coating, spray coating, spinner coating, bead coating, Meyer bar coating, blade coating, roller coating or curtain coating.

The coated layer thus obtained is preferably dried until a touch dry state at room temperature, and then by heating. The drying by heating is preferably conducted for 5 minutes to 2 hours at 30° to 200° C.

The charge generation layer should preferably contain as much as amount possible of said charge generating material for obtaining sufficient light absorption, and be made thin, for example not exceeding 5 microns, preferably in a range from 0.01 to 1 micron, in order to shorten the stroke of the charge carriers generated in said layer. These conditions are derived from requirements that a major portion of the incident light is absorbed in the charge generation layer to generate a large amount of charge carriers, and that the generated charge carriers are injected into the charge transport layer without deactivation by recombination or trapping.

The charge transport layer is electrically connected with said charge generation layer, and performs functions of receiving the charge carriers injected from the charge generation layer in the presence of an electric field and transporting said charge carriers to the surface. Said charge transport layer may be laminated on or under the charge generation layer but is preferably provided thereon.

The charge transport layer can be composed of a photoconductor since it is generally capable of transporting charge carriers.

The charge transporting material in the charge transport layer is preferably substantially non-sensitive to the wavelength range of the electromagnetic wave to which the charge generation layer is sensitive. The electromagnetic wave includes light in a wide sense, such as gamma ray, X-ray, ultraviolet light, visible light, near-infrared light, infrared light and far-infrared light. If the sensitive wavelength range of the charge transport layer coincides or overlaps with that of the charge generation layer, the charge carriers generated in both layers cause mutual trapping, thus eventually resulting in a loss in the sensitivity.

The charge transporting material can be an electron transporting material or a hole transporting material. The examples of the electron transporting materials are chloroanyl, bromoanyl, tetracyano-ethylene, tetracyanoquinodimethane, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone, 2,4,8-trinitrothioxanthone and similar electron acceptors, and polymers of such electron acceptors.

Examples of the hole transporting material are pyrene, N-ethylcarbazole, N-isopropylcarbazole, N-methyl-N-phenylhydrazino-3-methylidene-9-ethylcarbazole, N,N-diphenylhydrazino-3-methylidene-9-ethylcarbazole, N,N-diphenylhydrazino-3-methylidene-10-ethylphenothiazine, N,N-diphenylhydrazino-3-methylidene-10ethylphenoxazine; hydrazones such as p-diethylamino-benzaldehyde-N,N-diphenylhydrazone, p-diethylaminobenz-aldehyde-N-α-naphthyl-N-phenylhydrazone, p-pyrrolidinobenzaldehyde-N,N-diphenylhydrazone, 1,3,3-trimethylindolenine-w-aldehyde-N,N-diphenylhydrazone or p-diethylbenzaldehyde-3-methylbenzthiazolinone-2-hydrazone; pyrrazolines such as 2,5-bis(p-diethylaminophenyl)-1,3,4-oxadiazole, 1-phenyl-3-(p-diethylaminostyryl)-5-(p-diethylaminophenyl)pyrrazoline, 1 [quinolyl(2)]-3-(p-diethylaminostyryl)-5-(p-diethylaminophenyl)-pyrrazoline, 1-[pyridyl(2)]-3-(p-diethylaminostyryl)-5-(p-diethylaminophenyl)pyrrazoline, 1-[6-methoxypyridyl(2)]-3-(p-diethylaminostyryl)-5-(p-diethylaminophenyl)pyrrazoline, 1-[pyridyl(3)]-3-(p-diethylaminostylyl)5-(p-diethylaminophenyl)pyrrazoline, 1-[lepidyl(2)]3-(p-diethylaminostyryl)-5 (p-diethylaminophenyl)pyrrazoline, 1-[pyridyl(2)]-3-(p-diethylainostyryl)-4-methyl-5-(p-diethylaminophenyl)pyrrazoline, 1-[pyridyl(2)]-3-(α-methyl-p-diethylaminostyryl)-5-(p-diethylainophenyl)pyrrazoline, 1-phenyl-3-(p-diethylamino-styryl)-4-methyl-5-(p-diethylaminophenyl)-pyrrazoline, 1-phenyl-3-(α-benzyl-p-diethylaminostyryl)-5-(p-diethylaminophenyl)pyrrazoline or spiropyrrazoline; oxazoles such as 2-(p-diethylaminostyryl)-6-diethylaminobenzoxazole or 2-(p-diethylaminophenyl)-4-(p-dimethylaminophenyl)-5-(2-chlorophenyl-)oxazole; thiazoles such as 2-(p-diethylaminostyryl)-6-diethylaminobenzothiazole; triarylmethanes such as bis(4-diethylamino-2-methylphenyl)-phenylmethane; polyarylalkanes such as 1,1-polyarylalkanes such as 1,1-bis (bis(4-N,N-diethylamino-2-methylphenyl)heptane or 1,1, 2,2-tetrakis(4-N,N-dimethylamino-2-methylphenyl)ethane; triphenylamine, poly-N-vinylcarbazole, polyvinylpyrene, polyvinylanthracene, polyvinylacrydine, poly-9-vinylphenylanthracene, pyrene-formaldehyde resins, and ethylcarbazole-formaldehyde resins.

In addition to such organic charge transporting materials there may be employed inorganic materials such as selenium, selenium-tellurium, amorphous silicon and cadmium sulfide.

Also said charge transporting materials may be employed singly or in combination.

If the charge transporting materials lack film forming property, a layer can be formed by the use of an appropriate binder. Examples of the resin employable as the binder are insulating resins such as acrylic resins, polyallylate, polyester, polycarbonate, polystyrene, acrylonitrile-styrene copolymers, acrylonitrile-butadiene copolymers, polyvinyl butyral, polyvinyl formal, polysulfone, polyacryl amide, polyamide or chlorinated rubber; and organic photoconductive polymers such as poly-N-vinylcarbazole, polyvinylanthracene or polyvinylpyrene.

The thickness of the charge transport layer cannot be made excessively large due to the limination in the transportation of the charge carriers, and is generally in a range from 5 to 30 microns, preferably from 8 to 20 microns. In case of forming the charge transport layer by coating, there may be employed the aforementioned coating methods.

The photosensitive layer composed of a laminate structure of such charge generation layer and charge transport layer is provided on a substrate provided with a conductive layer. Such substrate with conductive layer can be composed of a conductive substrate such as aluminum, aluminum alloy, copper, zinc, stainless steel, vanadium, molybdenum, chromium, titanium, nickel, indium, gold or platinum; or a plastic substrate (for example polyethylene, polypropylene, polyvinyl chloride, polyethylene terephthalate, acrylic resin or polyfluorinated ethylene) provided with a layer, formed by a vacuum vapor deposition method, of aluminum, aluminum alloy, indium oxide, tin oxide or indium oxide-tin oxide alloy; a plastic substrate coated with conductive particles such as carbon black or silver powder together with a suitable binder; a plastic or paper substrate impregnated with conductive particles; or a plastic substrate containing conductive polymer.

Between the conductive layer and the photosensitive layer there may be provided a subbing layer functioning as a barrier and achieving adhesion. Such subbing layer can be composed of casein, polyvinyl alcohol, nitrocellulose, ethylene-acrylic acid copolymer, polyamides such as nylon-6, nylon-66, nylon 610, copolymerized nylon or alkoxymethylated nylon, polyurethane, gelatin or aluminum oxide.

The thickness of said subbing layer is generally in a range from 0.1 to 5 microns, preferably from 0.5 to 3 microns.

In case of a photosensitive member in which the conductive layer, charge generation layer and charge transport layer are laminated in this order and in which charge transporting material is composed of an electron transporting material, the surface of the charge transport layer has to be charged positively, and, in response to an exposure to light after said charging, the electrons generated in the charge generation layer are injected, in an exposed area, into the charge transport layer and reach the surface to neutralize the positive charge, thereby attenuating the surface potential and thus creating an electrostatic contrast to an unexposed area. An electrostatic latent image thus obtained can be developed with negatively charged toner to obtain a visible image, which can be fixed directly or on a sheet of paper or plastic after transfer of the toner image thereonto.

It is also possible to transfer the electrostatic latent image of the photosensitive member onto an insulating layer of a transfer sheet, then to develop said image and to fix thus developed image. The developer, developing method and fixing method are not limited to certain specific ones but can be suitably selected from already known materials and methods.

On the other hand, in case the charge transporting material is composed of a hole transporting material, the surface of the charge transport layer has to be charged negatively. In response to an exposure to light after said charging, the positive holes generated in the charge generation layer are injected, in an exposed area, into the charge transport layer and reach the surface to neutralize the negative charge, thereby attenuating the surface potential and thus generating an electrostatic contrast to an unexposed area. In this case positively charged toner has to be used for image development. Also there may be employed a photosensitive member in which the conductive layer, charge transport layer and charge generation layer are laminated in this order.

The electrophotographic photosensitive member employing the acetal resin of the present invention as the binder of the charge generation layer has the advantages of providing an improved sensitivity, showing smaller variations in the light portion potential and dark portion potential in the repeated use, and effectively avoiding so-called photomemory phenomenon. The photomemory is a phenomenon in which an area subjected to light irradiation prior to charging shows a lower potential at said charging, in comparison with other areas not subjected to such light irradiation, thus forming a white area in the obtained image.

Now the present invention will be clarified further by examples thereof.

EXAMPLE I

An ammonia solution of casein, containing 11.2 gr. of casein and 1 gr. of 28% ammonia water in 222 ml. of water, was coated with a wire-round bar onto an aluminum plate to obtain a dry thickness of 1.0 micron.

Then 5 gr. of a disazo pigment of the following structure:

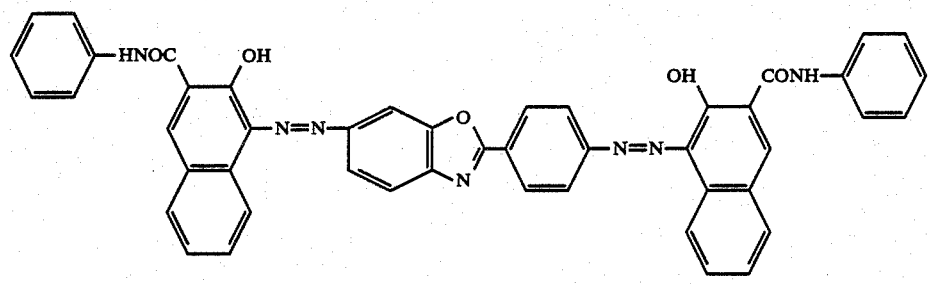

of which synthesis is disclosed in the Japanese Patent Laid-open No. 116039/1981, was added to a solution containing 3 gr. of a polyvinylacetal resin of the aforementioned resin example No.1 in 90 ml. of tetrahydrofurane and dispersed for 10 hours with attriter. The dispersion thus obtained was coated on the previously formed casein layer with a wire bar to a thickness of 0.3 microns after drying, and was dried at 70° C. to form the charge generation layer.

Subsequently 5 gr. of a hydrazone compound of the following structure:

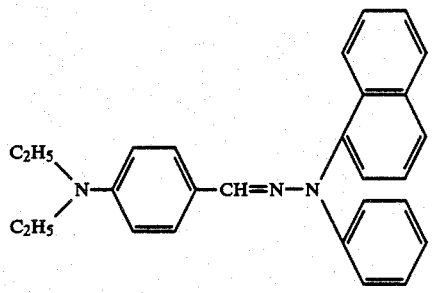

of which synthesis is disclosed in the Japanese Patent Laid-open No. 101844/1982, and 5 gr. of a polymethylmethacrylate resin with number-averaged molecular weight of 100,000 were dissolved in 70 ml. of toluene, and the obtained solution was coated with a wire bar on said charge generation layer and dried to form the charge transport layer of a dry thickness of 15 microns. In this manner a sample of Example 1 was prepared (Sample 1).

Also a comparative sample of the electrophotographic photosensitive member was prepared in the identical manner except that the above-mentioned polyvinylacetal resin No. 1 was replaced by a butyral resin S-LEC BM-2 supplied by Sekisui Chemical Industries Co., Ltd.

The electrophotographic photosensitive members thus prepared were subjected to a test of charging characteristics by corona charging at −5kV in static method with an electrostatic copying sheet tester Model SP-428 manufactured by Kawaguchi Denki Co., then holding the sample for 10 seconds in a dark place and irradiating the sample with an intensity of 5 lux.

As the charging characteristics there were measured the surface potential $V_0$ and a half-peak exposure $E_{1/2}$ required for attenuating the potential, after dark attenuation for 10 seconds, to a half. Also the samples were irradiated for 3 minutes with an intensity of 600 lux, then placed in a dark place for 1 minute and subjected to the measurement of charging characteristics, and the photomemory phenomenon was evaluated from the difference of the surface potential $V_0'$ in said measurement and the initial surface potential $V_0$. The results are summarized in Table 1.

TABLE 1

| | $V_0$ (volt) | $E_{\frac{1}{2}}$ (lux · sec) | $V_0$-$V_0'$ (volt) |
|---|---|---|---|
| Sample 1 | 600 | 2.3 | 40 |
| Comparative sample | 605 | 4.5 | 120 |

As will be apparent from Table 1, the sample 1 is superior, in sensitivity and photomemory phenomenon, to the comparative sample utilizing the commercially avaiable binder.

Also for evaluating the stability in repeated use, the foregoing samples were adhered onto a cylinder for the photosensitive drum for a Canon plain paper copying machine NP-150Z, then subjected to 10,000 copying cycles and there were measured the variations in the light potential $D_L$ and dark potential $V_D$ before and after said 10,000 copying cycles. The obtained results are shown in Table 2.

TABLE 2

| | Initial | | After 10,000 copy cycles | |
|---|---|---|---|---|
| | $V_D$ | $V_L$ | $V_D$ | $V_L$ (volt) |
| Ex. 1 sample | 690 | 150 | 685 | 165 |
| Comparative sample | 700 | 235 | 630 | 355 |

Results shown in Table 2 indicate that the sample of the Example 1 is superior also in the stability in continuous copying cycles to the comparative sample.

EXAMPLE 2 to 19

148 gr. of phthalic anhydride, 180 gr. of urea, 25 gr. of anhydrous cuprous chloride, 0.3 gr. of ammonium molybdenate and 370 gr. of benzoic acid were reacted under agitation for 3.5 hours at 190° C. Then benzoic acid was distilled off under a reduced pressure, and the residue was subjected to washing with water, filtration, washing with acid, filtration, washing with water and filtration to obtain 130 gr. of crude copper phthalocyanine.

Said crude copper phthalocyanine was dissolved in 1300 gr. of conc. sulfuric acid, then agitated for 2 hours at room temperature, and poured into a large amount of iced water. The precipitated pigment was separated by filtration, and washed with water until the washing water becomes neutral.

The product was then subjected to 6 cycles of agitation and filtration with 2.6 liters of dimethyl formamide (DMF), 2 cycles of agitation and filtration with 2.6 liters of methylethylketone (MEK), and 2 cycles of agitation and filtration with 2.6 liters of water, and dried in vacuum to obtain 115 gr. of pure copper phthalocyanine.

The charge generation layers were prepared in a process similar to that of the Example 1, each employing 5 gr. of the above-mentioned copper phthalocyanine pigment and 1.7 gr. of the acetal resin Nos. 2 to 19 as a binder. On each charge genaration layer there was laminated the charge transport layer of a thickness of 15 microns employing a pyrrozoline compound of the following structure:

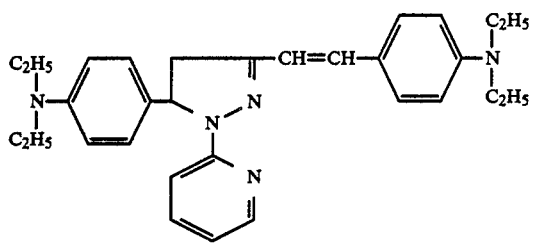

instead of hydrazone compound in the Example 1, thereby forming an electrophotographic photosensitive member.

The photosensitive members thus prepared were subjected to the measurement of charging characteristics and durability as in the Example 1, of which results are summarized in Table 3.

The acetal resins employed in these examples were synthesized in the same manner as in the Example 1 from polyvinyl alcohol supplied by Kuraray, and the degree of acetalization was measured according to the Japanese Industrial Standard.

TABLE 3

| Example | Acetal resin No. | deg. of acetalization (mol %) | Charging characteristics $V_0$ (v) | $E_{\frac{1}{2}}$ (lux · sec) | $V_0-V_0'$ (v) | Initial $V_D$ (v) | Initial $V_L$ (v) | After 10,000 copy cycles $V_D$ (v) | After 10,000 copy cycles $V_L$ (v) |
|---|---|---|---|---|---|---|---|---|---|
| 2 | 2 | 85 | 595 | 2.5 | 30 | 700 | 165 | 685 | 175 |
| 3 | 3 | 81 | 605 | 3.0 | 20 | 710 | 200 | 700 | 220 |
| 4 | 4 | 84 | 600 | 2.0 | 15 | 690 | 135 | 660 | 160 |
| 5 | 5 | 79 | 585 | 2.0 | 20 | 695 | 140 | 680 | 170 |
| 6 | 6 | 76 | 610 | 2.7 | 35 | 690 | 190 | 685 | 230 |
| 7 | 7 | 83 | 600 | 1.8 | 10 | 700 | 130 | 690 | 130 |
| 8 | 8 | 85 | 605 | 2.1 | 40 | 715 | 145 | 700 | 180 |
| 9 | 9 | 75 | 590 | 2.8 | 50 | 700 | 205 | 675 | 245 |
| 10 | 10 | 86 | 595 | 1.9 | 15 | 690 | 140 | 660 | 165 |
| 11 | 11 | 78 | 610 | 3.6 | 65 | 705 | 230 | 700 | 265 |
| 12 | 12 | 77 | 605 | 2.2 | 10 | 695 | 150 | 695 | 185 |
| 13 | 13 | 80 | 610 | 1.9 | 5 | 695 | 140 | 680 | 145 |
| 14 | 14 | 82 | 600 | 2.5 | 20 | 700 | 170 | 680 | 180 |
| 15 | 15 | 81 | 590 | 2.4 | 30 | 695 | 175 | 695 | 185 |
| 16 | 16 | 84 | 600 | 2.6 | 35 | 700 | 180 | 680 | 205 |
| 17 | 17 | 74 | 605 | 1.8 | 5 | 710 | 135 | 700 | 135 |
| 18 | 18 | 73 | 610 | 2.0 | 20 | 700 | 150 | 700 | 170 |
| 19 | 19 | 76 | 600 | 2.0 | 10 | 695 | 140 | 680 | 145 |

EXAMPLE 20

The charge generation layer was prepared in the identical manner as in the Example 1, except that the disazo pigment was replaced by 5 gr. of chlorocyan blue, and that the acetal resin No.2 was employed in an amount of 2.5 gr. On said charge generation layer there was coated a solution of 5 gr. of 2,4,7-trinitro-9-fluorenone and 5 gr. of poly-4,4'-dioxydiphenyl-2,2'-propane carbonate (molecular weight 300,000) in 70 ml. of tetrahydrofurane with a dry coating weight of 10 g/m$^2$.

The photosensitive member thus prepared was subjected to the measurement of charging characteristics in the same manner as in the Example 1. The electrostatic copying sheet tester was set and the copying machine NP-150Z was modified to obtain positive charging. The obtained results are shown in Table 4.

TABLE 4

| | $V_0$ (v) | $E_{\frac{1}{2}}$ (lux · sec) | Initial $V_D$ (v) | Initial $V_L$ (v) | After 10,000 copying cycles $V_D$ (v) | After 10,000 copying cycles $V_L$ (v) |
|---|---|---|---|---|---|---|
| Ex. 20 | 610 | 3.5 | 700 | 220 | 690 | 250 |

What is claimed is:

1. An electrophotographic photosensitive member comprising at least a charge generation layer and a charge transport layer on an electroconductive substrate, wherein said charge generation layer contains, as a binder, a polyvinylacetal resin obtained by acetalization reaction of polyvinyl alcohol and aldehyde compound represented by the following general formula:

Ar-CHO wherein Ar is a substituted or unsubstituted aryl radical.

2. An electrophotographic photosensitive member according to claim 1, wherein the content of said polyvinylacetal resin in said charge generation layer is in a range from 20 to 90 wt.%.

3. An electrophotographic photosensitive member according to claim 1, wherein said radical Ar is selected from the group consisting of phenyl, naphthyl, acenaphthyl, anthryl, pyrenyl, phenanthryl and azulenium.

4. An electrophotographic photosensitive member according to claim 1, wherein said polyvinylacetal resin has a degree of acetalization at least equal to 50 mol.%.

5. An electrophotographic photosensitive member according to claim 4, wherein said degree of acetalization is in a range from 65 to 90 mol.%.

6. An electrophotographic photosensitive member according to claim 1, wherein the charge generating material contained in the charge generation layer is an organic pigment.

7. An electrophotographic photosensitive member according to claim 6, wherein said organic pigment is an azo pigment.

8. An electrophotographic photosensitive member according to claim 6, wherein said organic pigment is a phthalocyanine pigment.

* * * * *

UNITED STATES PATENT AND TRADEMARK OFFICE

CERTIFICATE OF CORRECTION

PATENT NO. : 4,717,636

DATED : January 5, 1988

INVENTOR(S) : HIDEYUKI TAKAHASHI, ET AL.

It is certified that error appears in the above-identified patent and that said Letters Patent is hereby corrected as shown below:

COLUMN 1

Line 59, "functuation" should read --fluctuation--.

COLUMN 2

Line 30, "axulenyl." should read --azylenyl.--.
Line 65, "from," should read --from--.

COLUMN 6

Line 28, "α" should read --ß--.
Lines 51-53,

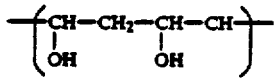

should read

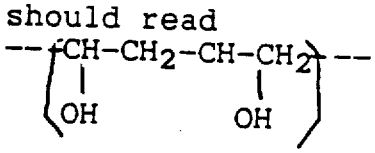

COLUMN 7

Line 16, "acetalization said" should read --acetalization of said--.

COLUMN 8

Line 13, "as" (second occurrence) should read --an--.
Line 63, "10ethylphenoxazine;" should read --10-ethylphenoxazine;
Line 67, "w-aldehyde-" should read --ω-aldehyde---.

UNITED STATES PATENT AND TRADEMARK OFFICE

CERTIFICATE OF CORRECTION

PATENT NO. : 4,717,636

DATED : January 5, 1988

INVENTOR(S) : HIDEYUKI TAKAHASHI, ET AL.

It is certified that error appears in the above-identified patent and that said Letters Patent is hereby corrected as shown below:

COLUMN 9

Line 11, "[lepidyl(2)]3-" should read --[lepidyl(2)]-3---.
Line 11, "-5 (p-diethylamino-" should read ---6-(p-diethylamino---.
Line 15, "diethylainophenyl)" should read --diethylaminophenyl)--.
Line 25, "polyarylalkanes such as" (second occurrence) should be deleted.
Line 26, "1,1-bis (bis" should read --bis--.
Line 51, "limination" should read --limitations--.

COLUMN 12

Line 44, "$D_L$" should read --$V_L$--.
Line 58, "EXAMPLE 2 to 19" should read —EXAMPLES 2 to 19--.

UNITED STATES PATENT AND TRADEMARK OFFICE

CERTIFICATE OF CORRECTION

PATENT NO. : 4,717,636

DATED : January 5, 1988

INVENTOR(S) : HIDEYUKI TAKAHASHI, ET AL.

It is certified that error appears in the above-identified patent and that said Letters Patent is hereby corrected as shown below:

COLUMN 13

Line 18, "genaration" should read --generation--.
Line 20, "pyrrozoline" should read --pyrrazoline--.

Signed and Sealed this

Seventeenth Day of May, 1988

*Attest:*

*Attesting Officer*

DONALD J. QUIGG

*Commissioner of Patents and Trademarks*